US005683336A

United States Patent [19]

Pape

[11] Patent Number: 5,683,336

[45] Date of Patent: Nov. 4, 1997

[54] EXERCISE DEVICE

[76] Inventor: Leslie Pape, 43470 Algonquin Dr., Novi, Mich. 48375

[21] Appl. No.: 647,337

[22] Filed: May 9, 1996

[51] Int. Cl.[6] ..... A63B 21/02

[52] U.S. Cl. ..... 482/124; 482/121; 482/122; 482/74; 482/111

[58] Field of Search ..... 482/121, 124, 482/122, 125, 126, 74, 111

[56] References Cited

U.S. PATENT DOCUMENTS

| | | | |
|---|---|---|---|
| 399,699 | 3/1889 | Sachs | 482/126 |
| 1,432,013 | 10/1922 | Blake . | |
| 2,035,010 | 3/1936 | Rawlings . | |
| 3,162,441 | 12/1964 | Karlik . | |
| 3,999,752 | 12/1976 | Kupperman et al. . | |
| 4,441,707 | 4/1984 | Bosch . | |
| 4,540,173 | 9/1985 | Hopkins, Jr. . | |
| 4,685,671 | 8/1987 | Hagerman et al. . | |
| 4,911,439 | 3/1990 | Kuhl . | |
| 4,993,705 | 2/1991 | Tolle . | |
| 5,186,701 | 2/1993 | Wilkinson | 482/124 |
| 5,337,737 | 8/1994 | Rubin et al. | 482/111 |
| 5,433,688 | 7/1995 | Davies . | |
| 5,518,480 | 5/1996 | Frappier | 482/124 |

FOREIGN PATENT DOCUMENTS

| | | |
|---|---|---|
| 20463 | 9/1907 | United Kingdom . |
| 245274 | 1/1925 | United Kingdom . |

*Primary Examiner*—Lynne A. Reichard
*Attorney, Agent, or Firm*—Reising, Ethington, Barnard & Perry, PLLC

[57] ABSTRACT

An exercise device to be worn on the user's body. The exercise device includes a resistance arm connected by pivot means at the ends thereof to mechanisms for mounting the resistance arm at spaced apart locations on the human body. The mechanisms for mounting include an arm harness at one end and a body harness at the other end, or a pair of straps for mounting around either an arm or a leg of the user's body spaced above and below an elbow or a knee, respectively.

12 Claims, 2 Drawing Sheets

44
16a
16b
16c
10
12
14
15
16
18
22
24
26
28
30
32
34
36
38
40
42
46
48

EXERCISE DEVICE

TECHNICAL FIELD

This invention relates generally to exercise devices and, more particularly, to such a device worn by a user for flexing the user's upper body muscles, for example, the muscles in the chest, back, shoulders, abdomen, sides, upper arms, lower arms, and neck.

BACKGROUND ART

Tolle U.S. Pat. No. 4,993,705 discloses an athletic device for the upper body, including a vest, and a elastically expandable strap fastened in place in an X-configuration across a back part of the vest and extended over the user's shoulders to terminate with two lower arm or wrist cuffs.

Kuhl U.S. Pat. No. 4,911,439 discloses a resilient exercise apparatus including a pair of loops made of a single length of elastic cord to form generally figure eight shape, and mounted over the shoulders and around the waist of the user, with a tubular handle mounted on each front and side sections of the cord.

Karlik U.S. Pat. No. 3,162,441 discloses an exercise device including a frame for mounting on the back or chest of a user via upper and lower belts, three springs and a plurality of pulleys on the frame to accommodate a flexible cord with two stirrups.

British patent no. 245,274 discloses an exercise device including a belt adapted to be secured around the waist or to be hung over the shoulders of the user, with elastic cords attached via springs to the belt, with hand grips at the ends thereof.

Exercise devices associated with waist belts and hand grips and/or wrist cuffs are shown and described in the following U.S. Pat. Nos.: Davies 5,433,688; Hagerman et al 4,685,671; Hopkins 4,540,173; Bosch 4,441,707; Kupperman et al 3,999,752; Rawlings 2,035,010; and Blake 1,432,013; and British patent no. 20,463.

DISCLOSURE OF THE INVENTION

A general object of the invention is to provide an improved exercise device worn by a user to exercise his or her upper body.

Another object of the invention is to provide an improved exercise device adapted to be worn on the user's upper body.

A further object of the invention is to provide an exercise device which includes a body harness and two arm harnesses connected by resistance arms.

Still another object of the invention is to provide an alternate arrangement wherein resistance arms may be used in conjunction with securing straps at the ends thereof for fastening around a user's arms or legs, straddling elbows or knees.

These and other objects and advantages will become more apparent when reference is made to the following drawings and the accompanying description.

BEST MODE FOR CARRYING OUT THE INVENTION

Figures 1, 1A, 1B, 1C:
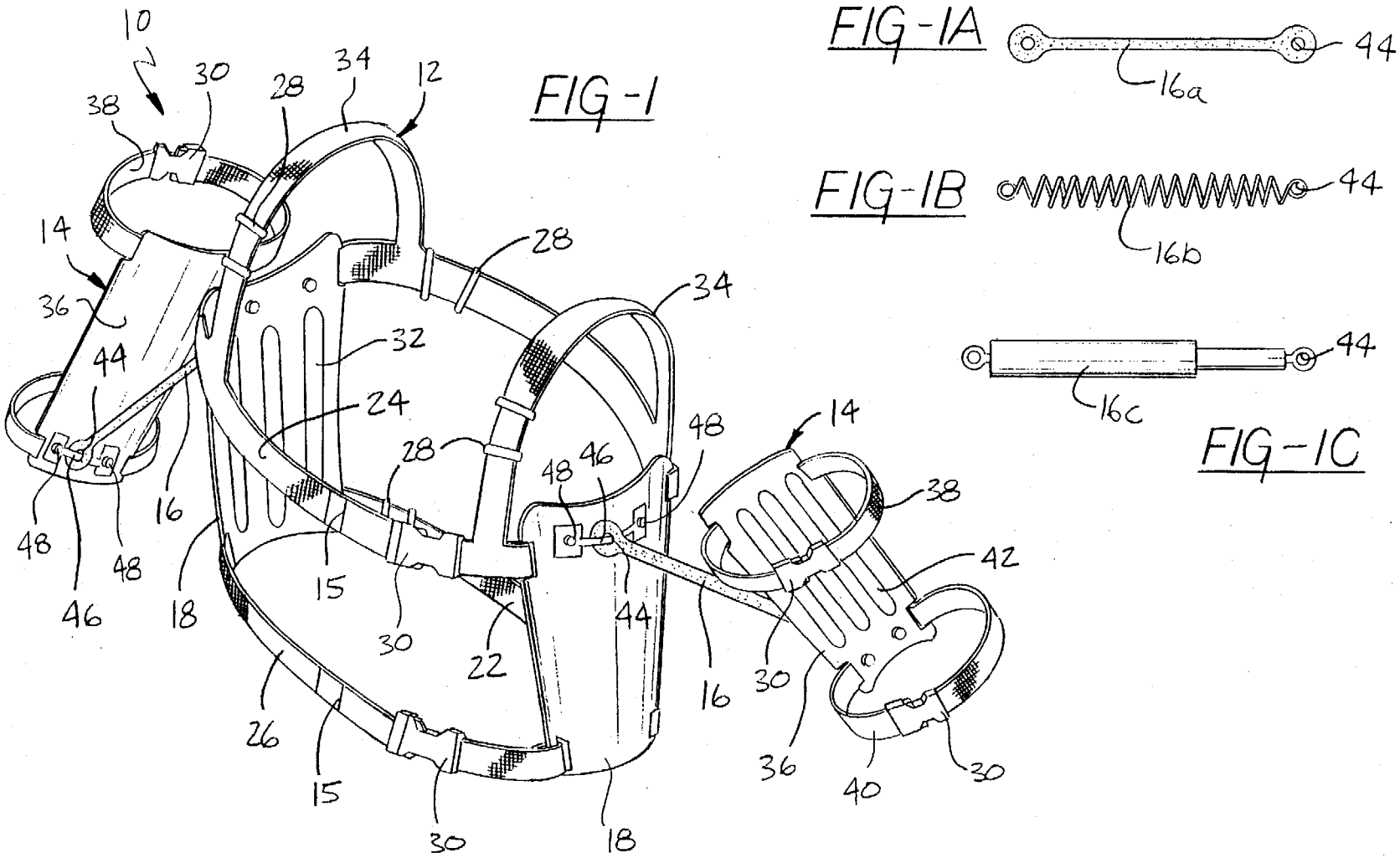
FIG. 1 is a perspective view of the invention.
FIGS. 1*a*, 1*b* and 1*c* are side elevational views of alternate embodiments of an element of the FIG. 1 apparatus.

Referring now to the drawings in greater detail, FIG. 1 illustrates an exercise device 10 including a body harness 12 and two arm harnesses 14 connected to the body harness by resistance arms 16.

The body harness 12 includes oppositely disposed, curved side support pads 18 connected at their rear top and bottom side portions by belts 20 and 22, respectively, and at their front top and bottom side portions by belts 24 and 26, respectively. Each rear belt 20 and 22 is adjustable by a suitable buckle 28, and each front belt 24 and 26 are two-piece belts connected together and adjustable by a suitable connector 30. Suitable padding 32 may be secured to the inner surface of each side support pad 18.

A pair of shoulder straps 34 extend in an arcuate configuration between oppositely disposed end portions of the upper front and rear belts 24 and 20, respectively. Each strap 34 is adjustable by a buckle 28.

Each arm harness 14 includes a curved arm support pad 36. Upper and lower two-piece straps 38 and 40 are connected to respective oppositely disposed upper and lower side portions of each arm support pad 36. Each two-piece strap 38 and 40 is connected together and adjusted by a connector 30. Padding 42 may be secured to the inner surface of each support pad 36.

Each resistance arm 16 includes an opening 44 formed through each end thereof. A suitable hook 46 extends through each opening 44, such that the arm 16 is pivotable about the hook. One hook 46 is secured by fasteners 48 at the ends thereof to an upper outer portion of each side support pad 18, and the other hook 46 is secured to a lower outer portion of each adjacent arm harness 14.

The resistance arm 16 may be an elastic rod-like member 16*a* (FIG. 1*a*), a metal coil spring 16*b* (FIG. 1*b*), or a hydraulic cylinder 16*c* (FIG. 1*c*).

Figure 3:
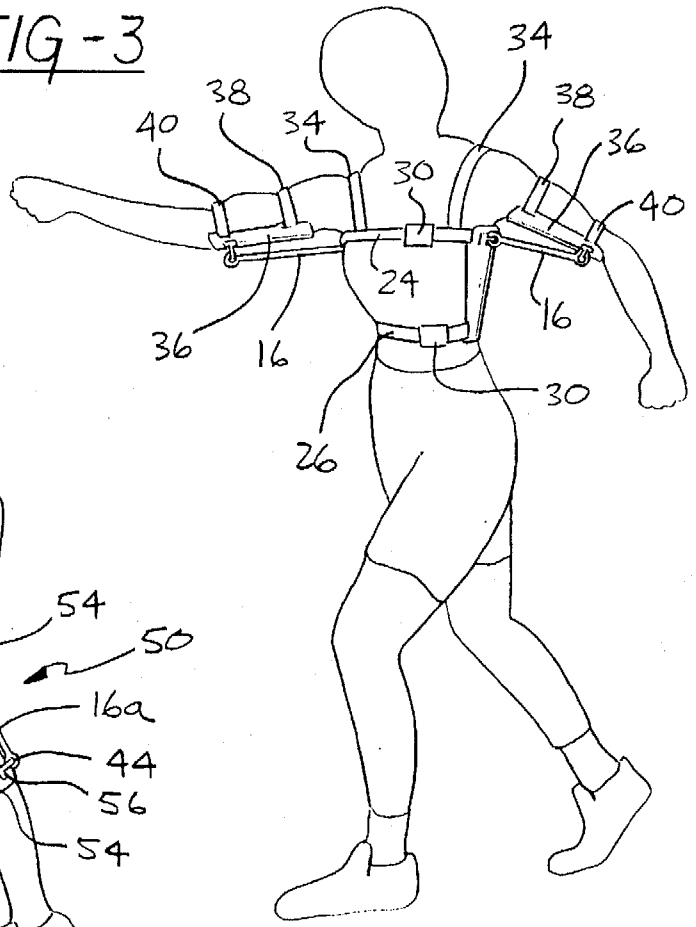
FIG. 3 is a perspective view of the FIG. 1 apparatus being used on the upper body of a person.
Figure 2:
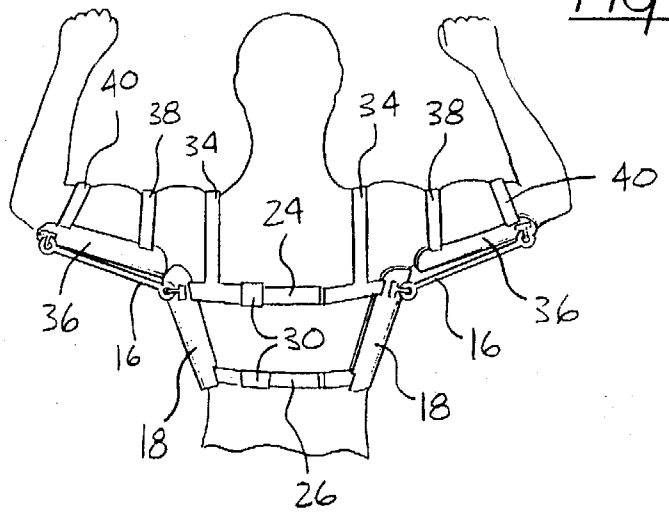
FIG. 2 is a front view of the FIG. 1 apparatus in place on a person's upper body.

In operation, as shown in FIGS. 2 and 3, the pair of straps 34 mount over the user's shoulders, and the upper and lower straps 38 and 40 mount around the user's upper arm, positioning the end of the resistance arm 16 close to the user's elbow. The side support pads 18 fit around the user's sides, with the top belts 20 and 24 extending across the user's upper back and chest, and the bottom belts 22 and 26 extending across the user's lower back and waist.

When mounted in this manner, various movements of the upper arms serve to extend or contract the resistance arms 16, thereby flexing muscles of the upper body in the chest, back, shoulders, abdomen, sides, upper arms, lower arms, and neck. The arm movements may be natural movements, while the user's legs may be moving or stationary. In place, the device 10 allows total freedom of movement of the user's whole body, and can be worn under or over clothing, and, if desired, can be used with other equipment, such as skis, treadmills, step machines, and cycles, or while sitting, lying, walking, running, or swimming.

Figure 5:
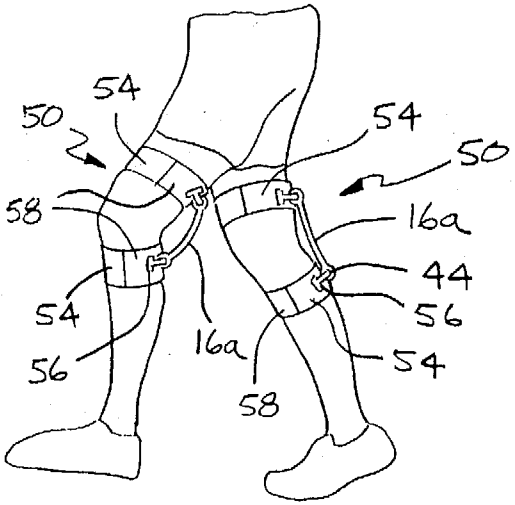
FIGS. 4 and 5 are perspective views of alternate embodiments of the invention in use on a person's arms and legs, respectively.
Figure 4:
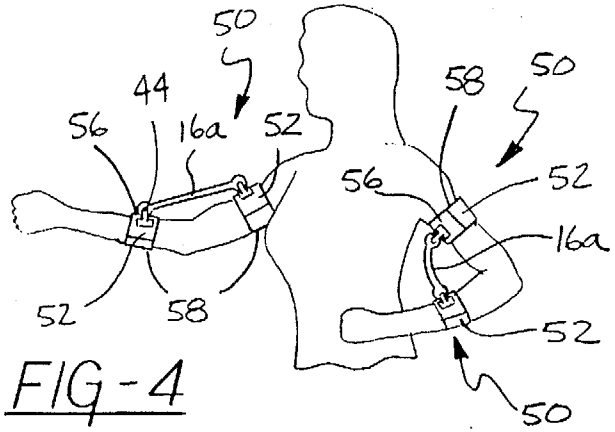

Referring now to FIGS. 4 and 5, a limb harness 50 includes a resistance arm 16*a* having an arm strap 52 or a leg strap 54 pivotally connected by a suitable connector 56 through each end opening 44 of the arm. Each strap 52 and 54 may be connected together by a suitable fastener, such as VELCRO, represented as 58, around the fore arm and upper arm, and around the calf and thigh, respectively.

In operation, movements of the arms and/or legs, against the resistance of the resistance arms 16*a*, serves to exercise the upper and lower arms, and the elbow joints, and/or the upper and lower legs, and the knee joints.

INDUSTRIAL APPLICABILITY

It should be apparent that the invention provides an improved upper body exercise device, wherein every upper body muscle group may be exercised while allowing total freedom of movement of the whole body.

It should also be apparent that, as an alternate embodiment, a portion of the complete upper body device may be used with suitable straps to mount on an arm or leg to isolate the areas around an elbow or a knee.

While but two embodiments of the invention have been shown and described, other modifications are possible within the scope of the following claims.

What is claimed is:

1. An exercise device for a person, said exercise device comprising a resistance arm and mounting means pivotally secured by pivot means at the ends of the resistance arm for mounting the resistance arm at spaced apart locations on the person, wherein said mounting means includes a pair of independent two-piece straps adapted for mounting around one of an arm and a leg of the person, with one independent strap mounted above and the other independent strap mounted below an elbow or a knee of the person, with the only connection therebetween being said resistance arm.

2. The exercise device described in claim 1, wherein said resistance arm is one of an elastic rod, a metal coil spring, and a hydraulic cylinder.

3. An exercise device for a person, said exercise device comprising a body harness and two arm harnesses, each arm harness pivotally connected to said body harness by a resistance arm, wherein said body harness includes a pair of side support pads, belt means interconnecting said pair of side support pads and adapted to mount around the person, shoulder straps connected to said belt mounts for mounting over shoulders of the person, and said resistance arm pivotally connected at one end thereof to one end of one of said pair of side support pads.

4. The exercise device described in claim 3, wherein said belt means includes upper front and rear belts and lower front and rear belt interconnecting upper and lower side portions of said pair of side support pads and adapted to mount around a chest and waist of the person.

5. An exercise device for a person, said exercise device comprising a body harness a resistance arm and mounting means pivotally secured by pivot means at the ends of the resistance arm for mounting the resistance arm at spaced apart locations on the person, wherein said body harness includes a pair of side support pads, belt means interconnecting said pair of side support pads and adapted to mount around the person, shoulder straps connected to said belt mounts for mounting over shoulders of the person, and said resistance arm pivotally connected at one end thereof to one end of one of said pair of side support pads.

6. The exercise device described in claim 5, wherein said belt means includes upper front and rear belts and lower front and rear belts interconnecting upper and lower side portions of said pair of side support pads and adapted to mount around a chest and waist of the person.

7. The exercise device described in claim 6, wherein said upper and lower front belts are two-piece belts, and connector means for adjusting and connecting each of said two-piece belts.

8. The exercise device described in claim 5, and a buckle on each shoulder strap for adjusting the length thereof.

9. The exercise device described in claim 1, wherein said pivot means includes openings through each end of said resistance arm, and a hook mounted through each said opening and secured to said mounting means.

10. An exercise device for a person, said exercise device comprising a pair of straps for mounting around one of an arm and a leg of the person adapted for straddling one of an elbow and a knee, respectively, and a resistance arm pivotally connected by pivot means at each end thereof to one of said pair of straps, said resistance arm being the only connection therebetween.

11. An exercise device for a person, said exercise device comprising a resistance arm and mounting means pivotally secured by pivot means at the ends of the resistance arm for mounting the resistance arm at spaced apart locations on the person, wherein said mounting means includes an arm harness, wherein said arm harness includes an arm support pad having a two-piece strap secured adjacent each end thereof, and connector means on each strap for securing same around an upper arm of the person, with said resistance arm pivotally connected at one end thereof adjacent one end of the support pad.

12. An exercise device for a person, said exercise device comprising a body harness and two arm harnesses, each arm harness pivotally connected to said body harness by a resistance arm, wherein each said arm harness includes an arm support pad having a two-piece strap secured adjacent each end thereof, and connector means on each strap for securing same around an upper arm of the person, with said resistance arm pivotally connected at one end thereof adjacent one end of the support pad.

* * * * *